US005186083A

United States Patent [19]

Hsiao

[11] Patent Number: 5,186,083

[45] Date of Patent: Feb. 16, 1993

[54] STRUCTURE OF Y-TYPE SOCKET WRENCH

[76] Inventor: K. H. Hsiao, 4, Lane 11, Tze Chiang St., Tu Cheng Shiang, Taipei Shien, Taiwan

[21] Appl. No.: 905,455

[22] Filed: Jun. 29, 1992

[51] Int. Cl.[5] ..... B25B 13/06

[52] U.S. Cl. ..... 81/124.4; 81/124.6; 81/125.1; 81/177.85; 81/DIG.11; 81/439

[58] Field of Search ..... 81/57.5, 437–439, 81/124.4–124.6, 125.1, 177.85, DIG. 11, 177.4, 490

[56] References Cited

U.S. PATENT DOCUMENTS 1,360,121 11/1920 Lawrence ..... 81/124.4
1,478,736 12/1923 Gadberry ..... 81/124.4

FOREIGN PATENT DOCUMENTS 735672 6/1966 Canada ..... 81/124.4
2442107 7/1980 France ..... 81/124.4

*Primary Examiner*—D. S. Meislin
*Attorney, Agent, or Firm*—Bacon & Thomas

[57] ABSTRACT

A T-type socket wrench having three hexagonal rods on three ends of a Y-shaped handle, and three double-head hexagon sockets of successive hexagonal holes mounted on the three hexagonal rods and stopped at respective first positions by respective first steel balls for turning hexagon head screws. Each double-head heaxgon socket is moved inwards on the respective hexagonal rod and stopped at a respective second position by a respective second steel ball permitting a hexagon bit of different size on the respective hexgonal rod to project out of the respective double-head hexagon socket for turning a socket head screw or the like.

3 Claims, 4 Drawing Sheets

(PRIORT ART)

STRUCTURE OF Y-TYPE SOCKET WRENCH

BACKGROUND OF THE INVENTION

The present invention relates to Y-type socket wrenches and relates more particularly to a Y-type socket wrench having three double-head hexagon sockets of different sizes for grasping and turning nuts, bolts, etc. of six different sizes.

A variety of Y-type socket wrenches are known and widely used for the advantage of capable of grasping and turning nuts, bolts, etc. of different sizes. These Y-type socket wrenches are generally comprised of a Y-shaped handle having three hexagonal sockets of different sizes (see FIG. 1) on the three terminal ends thereof for turning internal hexagon nuts, or three hexagonal bits of different sizes (see FIG. 2) for turning external hexagon nuts. Therefore, different Y-type socket wrenches shall be prepared for turning different types of hexagon nuts.

SUMMARY OF THE INVENTION

The present invention eliminates the aforesaid disadvantage. According to the preferred embodiment of the present invention, the Y-type socket wrench has three hexagonal rods on three ends of a Y-shaped handle, and three double-head hexagon sockets of successive hexagonal holes mounted on the three hexagonal rods and stopped at respective first positions by respective first steel balls for turning hexagon head screws. Each double-head hexagon socket is moved inwards on the respective hexagonal rod and stopped at a respective second position by a respective second steel ball permitting a hexagon bit of different size on the respective hexagonal rod to project out of the respective double-head hexagon socket for turning a socket head screw or the like.

DETAILED DESCRIPTION OF THE PREFERRED EMBODIMENT

Figure 1:
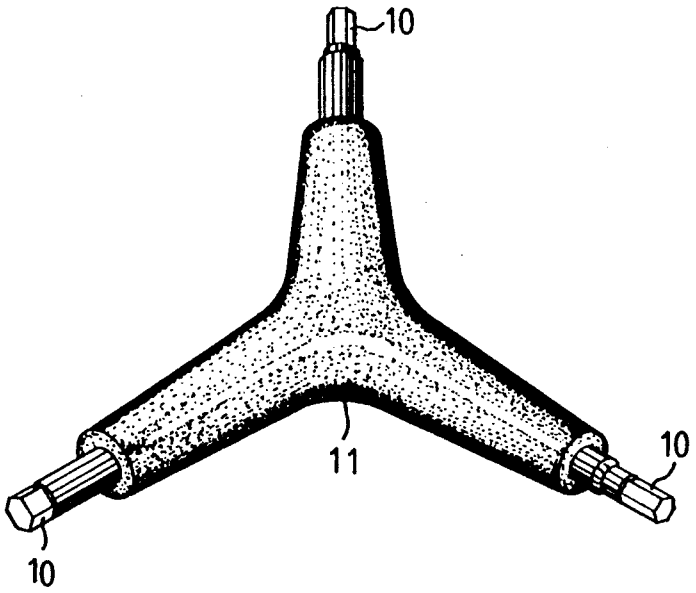
FIG. 1 (PRIOR ART)
FIG. 1 is an elevational view of a Y-type hexagonal fixed socket wrench according to the prior art.
Figure 2:
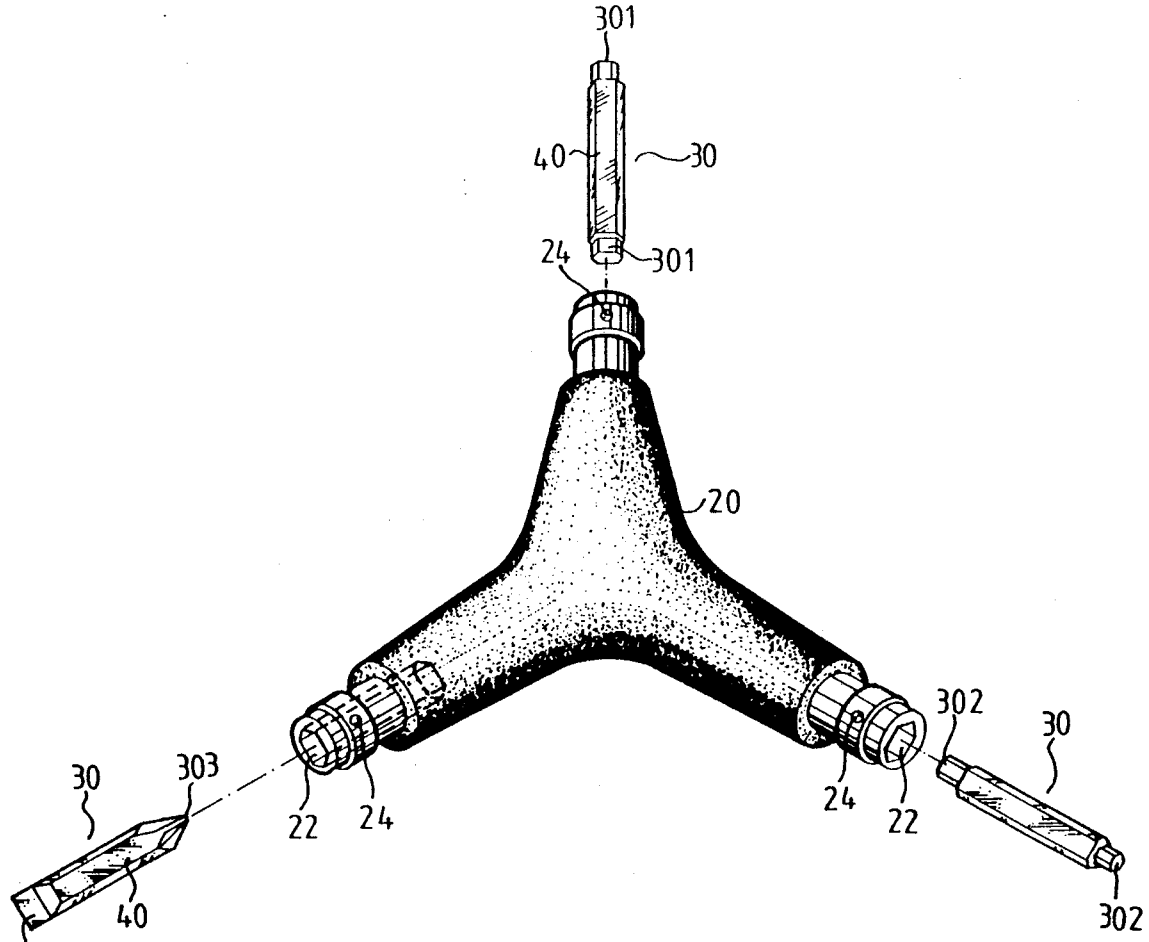
FIG. 2 is an elevational view of a Y-type hexagonal socket wrench according to the prior art.
Figure 3:
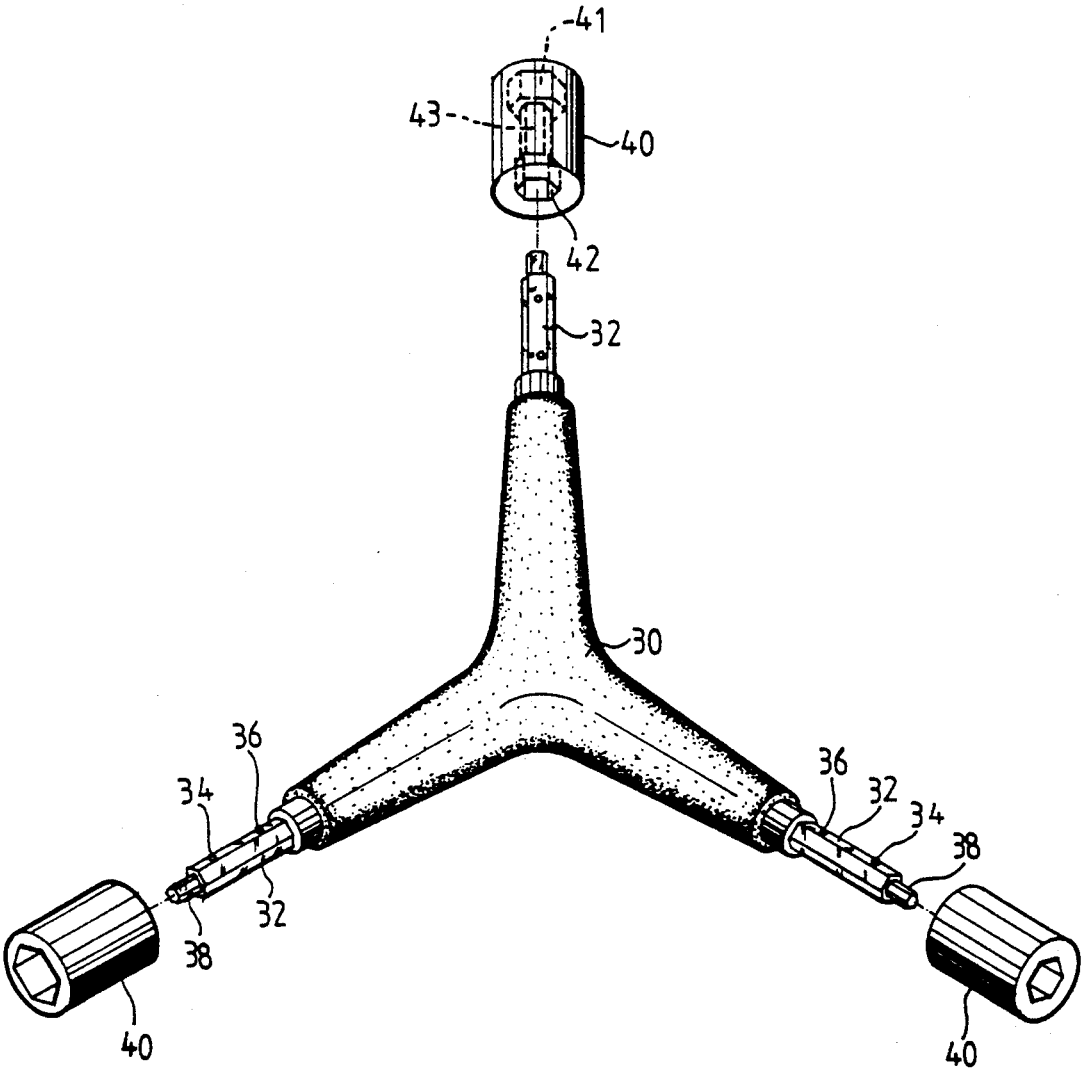
FIG. 3 is an exploded view of a Y-type socket wrench embodying the present invention.
Figure 4:
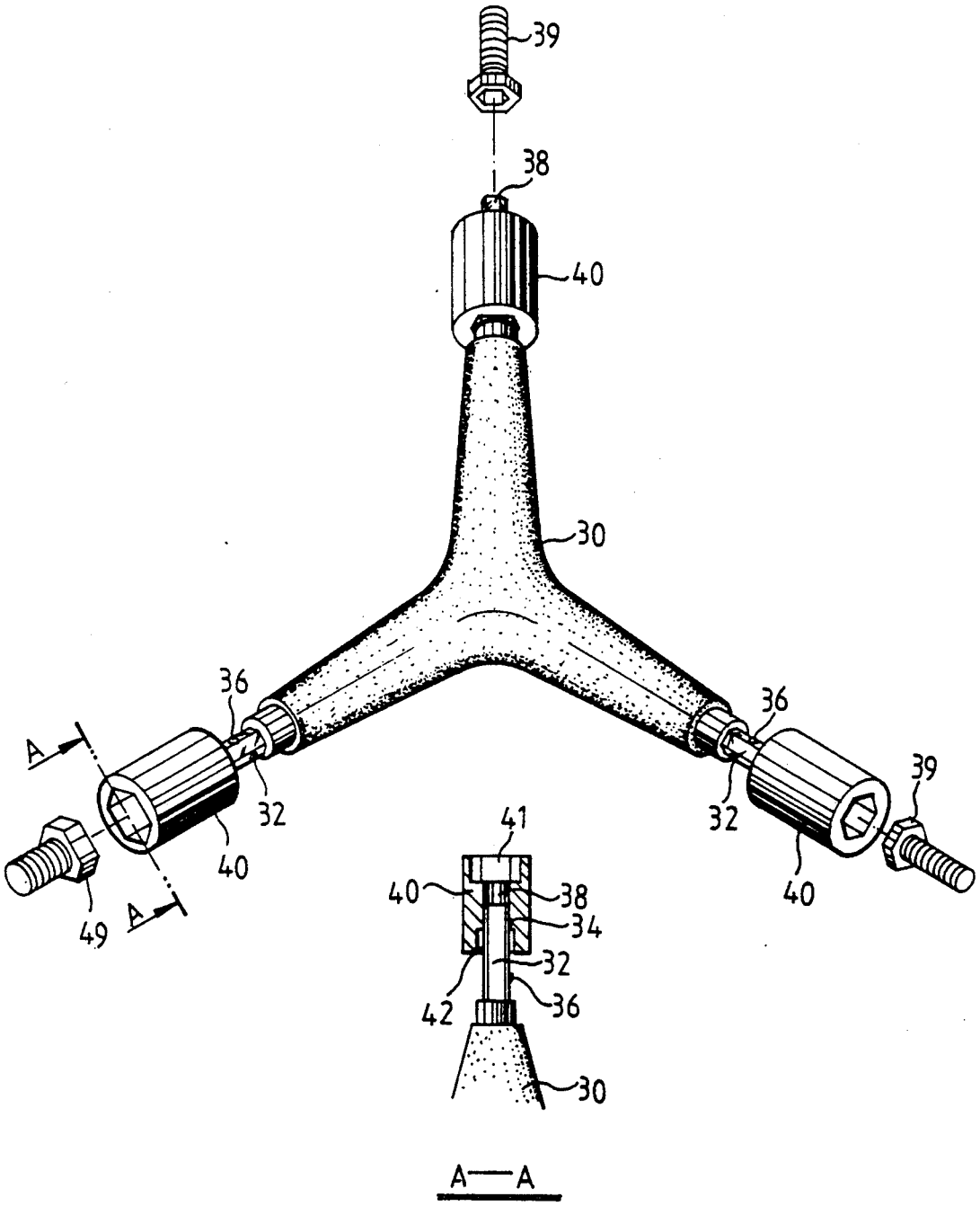
FIG. 4 is an elevational view and a partly sectional view of the Y-type socket wrench of FIG. 3.

Referring to FIGS. 3 and 4, a Y-type socket wrench as constructed in accordance with the present invention is generally comprised of a Y-shaped handle 30 having three hexagonal rods 32 of the same outer diameter longitudinally respectively made on the three terminal ends thereof. Each hexagonal rod 32 has two steel balls 34,36 respectively inserted in two spaced holes (not shown) on the outside surface thereof, and a hexagonal bit 38 on the top end thereof for turning a socket head screw 39. There are also provided three double-head hexagon sockets 40 respectively detachably fastened to the three hexagonal rods 32 for turning hexagon head screws 49 or the like. The double-head hexagon sockets 40 have each two hexagonal holes 41,42 on two opposite ends in successive sizes, and a hexagonal boring bore 43 connected between the hexagonal Therefore, the three double-head hexagon sockets 40 provide total six hexagonal holes in successive sizes for turning hexagon head screws or the like.

Because there are two steel balls 34,36 on each hexagonal rod 32, each double-head hexagon socket 40 can be alternatively stopped on the respective hexagonal rod 32 by either steel ball 34 or 36. When either double-head hexagon socket 40 was sleeved on either hexagonal rod 32 and stopped the outer steel ball 34, the opposite end of the double-head hexagon socket 40, namely, the hexagonal hole 41 or 42 projects over the respective hexagonal bit 38 for turning a hexagon head screw 49. Squeezing the the double-head hexagon socket 40 inwards to let it be stopped at the inner steel ball 36 causes the respective hexagonal bit 38 to project out of the hexagonal hole 41 or 42 of the double-head hexagon socket 40 for turning a socket head screw 39. The inner diameter of the hexagonal boring bore 43 is slightly bigger than the outer diameter of each hexagonal rod 32, either hexagonal rod 32 can be inserted into either double-head hexagon socket 40, and each double-head hexagon socket 40 can be mounted on either hexagonal rod 32 with either hexagonal hole 41 or 42 disposed on an outer side for turning a the three hexagonal rods 32 are of different sizes, however, the outer diameter of the biggest hexagonal bit 38 should be smaller than the outer diameter of the hexagonal rods 32. The hexagonal holes 41,42 of all the three double-head hexagon sockets 40 are of different sizes, however, the inner diameter of the smallest hexagonal hole should be bigger than the outer diameter of the hexagonal rods 32.

The steel balls 34,36 are received in respective holes on the respective hexagonal rod 32 and partly project over the outside surface of the respective hexagonal rod 32. Therefore, each steel ball will produce a friction force against the inside surface of the respective double-head hexagon socket 40 to retain it in place.

What is claimed is:

1. A Y-type socket wrench comprising:

a Y-shaped handle having three hexagonal rods of the same size on three ends thereof, said hexagonal rods having each a first steel ball and a second steel ball received in two spaced holes on an outside surface thereof and partly projected over the outside surface and a hexagon bit of different size on a top edge thereof for turning socket head screws;

three double-head sockets detachably mounted on said three polygonal rods, said double-head sockets opposite ends thereof and a hexagonal boring bore connected therebetween; and wherein each double-head socket can be stopped on the respective hexagonal rod at a first position by the respective first steel ball for turning a hexagon head screw, or stopped on the respective hexagonal rod at a second position by the respective second steel ball permitting the respective hexagon bit to extend out of the respective double-head socket for turning a socket head screw.

2. The Y-type socket wrench according to claim 1, wherein the three hexagonal bits of said three hexagonal rods are of different sizes, the biggest hexagonal bit having an outer diameter smaller than the outer diameter of said hexagonal rods.

3. The Y-type socket wrench according to claim 1, wherein the hexagonal holes of said three double-head hexagon sockets are of different sizes, the smallest hexagonal hole having an inner diameter bigger than the outer diameter of said hexagonal rods.

* * * * *